United States Patent [19]

Sullivan et al.

[11] 4,370,076

[45] Jan. 25, 1983

[54] TRANSPORTATION SYSTEMS AND ELECTRIC CABLES FOR USE THEREIN

[75] Inventors: Thomas Sullivan, Manchester; James E. Braddock, Wigan, both of England

[73] Assignee: Bicc Limited, London, England

[21] Appl. No.: 123,433

[22] Filed: Feb. 21, 1980

Related U.S. Application Data

[63] Continuation-in-part of Ser. No. 3,049, Jan. 12, 1979, abandoned, which is a continuation-in-part of Ser. No. 884,270, Mar. 7, 1978, abandoned.

[30] Foreign Application Priority Data

Mar. 10, 1977 [GB] United Kingdom ..... 10268/77

[51] Int. Cl.[3] ..... H01B 3/10

[52] U.S. Cl. ..... 405/132; 174/110 PM; 174/120 R; 174/120 SR; 428/389; 428/390; 104/138 R

[58] Field of Search ..... 104/138 R; 174/110 PM, 174/120 R, 120 SR, 121 A, 121 AR; 405/132; 428/372, 379, 383, 384, 389, 390, 391

[56] References Cited

U.S. PATENT DOCUMENTS

| | | | |
|---|---|---|---|
| 2,888,424 | 5/1959 | Precopio et al. | 174/110 PM |
| 3,425,865 | 2/1969 | Shelton | 174/120 SR X |
| 3,433,891 | 3/1969 | Zysk et al. | 174/120 R |
| 3,571,490 | 3/1971 | Bunish et al. | 174/120 R X |
| 3,823,255 | 7/1974 | Gase et al. | 174/121 AR |
| 3,911,202 | 10/1975 | Stine et al. | 174/110 PM |
| 3,922,442 | 11/1975 | North et al. | 428/389 X |
| 4,005,254 | 1/1977 | MacKenzie | 174/110 PM |
| 4,020,214 | 4/1977 | MacKenzie | 428/389 |

FOREIGN PATENT DOCUMENTS 972067 10/1964 United Kingdom .

OTHER PUBLICATIONS

ALCOA Bulletin The non-smoking fire retardant filler: ALCOA hydrated alumina reprint about Jan. 1976, 2 pages, Pittsburgh, Pa.

*Primary Examiner*—R. R. Kucia

*Attorney, Agent, or Firm*—Buell, Blenko, Ziesenheim & Beck

[57] ABSTRACT

A composition of high oxygen index that yields little visible smoke and little or no corrosive fume on combustion and having adequate mechanical and electrical properties for cable jackets and bedding comprises;

20–35 parts of ethylene-vinyl acetate copolymer;

52–75 parts of an alumina trihydrate with at least half its weight in particles with a diameter in the range 0.5–3.0 micrometer;

up to 3 parts of stearic acid or a stearate; and at least one antioxidant and if desired at least one curing agent in effective amounts not exceeding 4 parts in all.

A double-layer of aromatic polyimide tape, the first layer helically lapped and the second preferably longitudinally applied, is interposed between a bedding an a jacket both of the above composition to give a superior low-smoke cable for use in tunnels of railroads or other transportation systems.

4 Claims, 2 Drawing Figures

TRANSPORTATION SYSTEMS AND ELECTRIC CABLES FOR USE THEREIN

RELATED APPLICATIONS

This is a continuation-in-part of our application Ser. No. 3,049 filed Jan. 12, 1979, which was itself a contination-in-part of our application Ser. No. 884,270 filed Mar. 7, 1978, and which are both abandoned.

BACKGROUND OF THE INVENTION

This invention relates to transportation systems in which vehicles travel through tunnels formed by boring in the earth or by cutting trenches in the earth and subsequently covering them, and more especially, though not exclusively, to mass-transmit and other railroad systems; it also relates to electric cables that are designed specifically for use therein.

Large quantities of electric cable are installed in such systems for such purposes as signalling, trackside communication, track-to-train communication (radiating cables), provision of traction current, and auxiliary power circuits for the operation of route switches and other trackside equipment, station lighting, etc. For some of these purposes incombustible cables with compacted mineral insulation could be used, but for most the use of polymeric material in the insulation or jacket or both is a practical necessity. There is always some risk that polymeric materials, even though formulated for enhanced flame retardance, will burn if pre-heated to a high temperature by an external source, such as an external fire, with the risks that: (i) in certain circumstances fire may be transmitted along cable runs through the tunnels to other parts of the system; (ii) dense smoke may be generated; and (iii) since PVC and/or other halogen-containing materials are commonly present toxic and corrosive fumes (such as hydrogen chloride gas and/or hydrochloric acid droplets) may be produced. Obviously these risks must be minimised in the interest of the safety and comfort of passengers and the reliable and uninterrupted operation of the system.

Each of these risks, considered separately, can be avoided or at least contained by conventional formulation techniques, but the requirements are in conflict because most flame-retardant additives that are effective in halogen-free polymers themselves contain halogen and so contribute seriously to the hazard of toxic and corrosive fumes if the cables are burned, and there is a tendency for low-flammibility polymer compositions to smoulder and generate dense smoke when they do burn. Furthermore, improvements in characteristics that reduce fire hazards almost always do so at the expense of the mechanical and/or electrical properties of the composition.

It is an object of the invention to provide a cable for use in transportation systems that is halogen free, has adequate mechanical and electrical properties and combines a high oxygen index (low flammability) with the characteristic of producing, when burned under typical fire conditions, little visible smoke and no major quantity of toxic or corrosive fumes. The tunnels of a transportation system comprise a unique environment for the installation of electric cables, since they are subject neither to the chemical and mechanical effects of soil as are cables buried in the earth, nor to the effects of temperature extremes, sunlight, weather, abrasion or impact generally encountered above ground level. Accordingly they call for cables differently-optimised compared with those for other environments.

Joyce A. North et al. in U.S. Pat. No. 3,922,442 issued Nov. 25, 1975, have described uniinsulation compounds for electric cables based on copolymers of ethylene with vinyl acetate and containing large amounts of hydrated alumina and minor but essential amounts of silane. The experimental basis for North et al.'s teaching appears to be restricted to the use of plastic (non-rubbery) copolymers with either 17 or 28% vinyl acetate and filler levels up to 150 phr (parts per hundred of polymer). Within this range the applicants have no reason to doubt the teaching of North et al.; we have however worked with rubbery polymers with substantially more than 28% vinyl acetate and with higher filler loadings, and have found the teaching of the patent completely inaccurate and misleading in its references to these ranges.

Firstly, we have found that the use of the very expensive silane ingredient is not merely inessential but positively harmful when the polymer contains over 28% vinyl acetate; it has no significant effect on the compatibility of the filler with the polymer or on fire performance, and a marginal improvement in tensile strength of the blend is outweighed by a drastic loss of elongation.

Secondly, we have found that in these rubbery, high vinyl acetate copolymers the particle size of the hydrated alumina filler is critical to obtaining a high loading and a processable mixture, in direct contradiction of the teaching of North et al.

Thirdly, we have found that a loading of 400 phr or more of filler, as proposed by North et al is impossible to achieve by a considerable margin, and that a loading significantly over 150 phr is possible only when the vinyl acetate content of the polymer is well over 28%.

Furthermore we have made two surprising discoveries. Firstly, that by using silane-free high-vinyl acetate copolymer compositions with a controlled high loading of hydrated alumina it is possible to achieve, in a halogen-free low-smoke material with adequate physical properties for transportation cables, an increase in oxygen index that is very large compared with the marginal improvement obtained by North et al. (note that the highest oxygen index achieved by them for a composition of their invention was 28, which failed even to equal their own silane-free comparison example 6 when vulcanised (see tables C and E); the non-standard test with coated wires cannot be compared with standard tests on the composition itself and is not relevant to our purposes). Secondly, we have found that when our material is used for the outer, protective layers of a transportation cable, a significant and surprising improvement in smoke emission characteristics and in some cases in fire survival as well can be obtained by interposing a very thin aromatic polyimide tape layer between two layers of the filled copolymer composition.

SUMMARY OF THE INVENTION

In accordance with one aspect of our invention, therefore, an electric cable for use in a transportation system comprises a core comprising at least one polyer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having an oxygen index of at least 32 and up to about 50;

a tensile strength of at least 2.5 and up to 10 $MN/m^2$;

an elongation at break which is at least 200 and for a cured composition up to 500% and for an uncured composition up to 1000%;

a permittivity of about 5.5–6.0;

a power factor of about 2–4%;

a volume resistivity in the region of $10^{11}$ ohm m;

and which, if burned, produces little visible smoke and no major amount of toxic or corrosive fumes and comprising by weight 20–35 parts of a rubbery ethylene-vinyl acetae copolymer comprising more than 28% and up to about 45% vinyl acetate;

optionally up to 10 parts of another halogen-free polymer;

52–75 parts of an alumina trihydrate with at least half its weight in particles with a diameter in the range 0.5–3.0 micrometer;

up to 3 parts of a lubricant selected from those fatty acids and salts thereof which are compatible with the composition; and at least one antioxidant and optionally at least one curing agent in effective amounts not exceeding 4 parts in all; and said aromatic tape layer comprises at least two superposed tapes.

Preferably this aromatic polyimide tape layer consists of an inner tape helically applied to the bedding layer and an outer tape longitudinally applied to the inner tape.

We have observed that the jacket is liable to adhere to the underlying polyimide tape layer, and suspect that the surprising benefit of the preferred double tape layer defined is due in part to the fact that the outer layer eliminates stress concentrations that would otherwise arise at the joints of a helical tape during the bending inherent in handling and installation of the cable, but whether or not this theory is correct we have found that the preferred tape construction of our invention is significantly better in this respect than a double helical layer with the same bedding and jacket composition.

The invention also includes a transportation system comprising at least one tunnel through which vehicles pass in operation and having electrical cables extending longitudinally through said tunnel, characterised by the fact that at least one of said electric cables comprises a core comprising at least one polymer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having an oxygen index of at least 32 and up to about 50;

a tensile strength of at least 2.5 and up to 10 $MN/m^2$;

an elongation at break which is at least 200 and for a cured composition up to 500% and for an uncured composition up to 1000%;

a permittivity of about 5.5–60;

a power factor of about 2–4%;

a volume resistivity in the region of $10^{11}$ ohm m;

and which, if burned, produces little visible smoke and no major amount of toxic or corrosive fumes and comprising by weight 20–35 parts of a rubbery ethylene-vinyl acetate copolymer comprising more than 28% and up to about 45% vinyl acetate;

optionally up to 10 parts of another halogen-free polymer;

52–75 parts of an alumina trihydrate with at least half its weight in particles with a diameter in the range 0.5–3.0 micrometer;

up to 3 parts of a lubricant selected from those fatty acids and salts thereof which are compatible with the composition; and at least one antioxidant and optionally at least one curing agent in effective amounts not exeeding 4 parts in all; and said aromatic type layer comprises at least two superposed tapes.

Preferably the insulation, like the bedding and the jacket, is of halogen-free material.

If there is more than one conductor one (or exceptionally more than one but not all) of them may be bare.

The insulation is preferably of curable, mineral-filled, plasticised EPR or EPDM composition. Preferably the weight of mineral filler is not in any instance more than 55% of the whole insulating composition. The insulation may alternatively be suitable conventional compositions based on other halogen-free polymers, such as cross-linked polyethylene, silicone rubber or on compatible mixtures of any of these polymers.

In the bedding layer and the jacket, the vinyl acetate content of the copolymer is preferably at least 35%, and a content of 40% is considered best. The optional addition of a small amount of another suitably-chosen halogen-free polymer, such as a selected polyethylene or an EPR or EPDM improves toughness without serious degradation of fire performance. The proportion of the various ingredients, within the ranges defined, will be chosen to obtain the desired balance of properties, depending on the characteristics of the ethylene-vinyl acetate copolymer (or of each of the polymers) and the particle size distribution of the hydrated alumina.

Preferably polyimide tapes are those sold by E. I. Du Pont de Nemours & Co. under the trademark "Kapton H", which are understood to consist essentially of the polymeric pyromellitimide of p, p' diamno diphenyl ether. Within the commercially-available range, thickness is not critical; good results have been obtained with tapes about 0.08 mm, 0.05 mm, and 0.03 mm thick.

For some types of cable additional components of a conventional kind, for example wire or tape armour and/or a metal sheath, may be included, for example between the parts of a sub-divided bedding layer and/or between the parts of a sub-divided sheath.

DETAILED DESCRIPTION OF THE DRAWINGS

Figure 1:
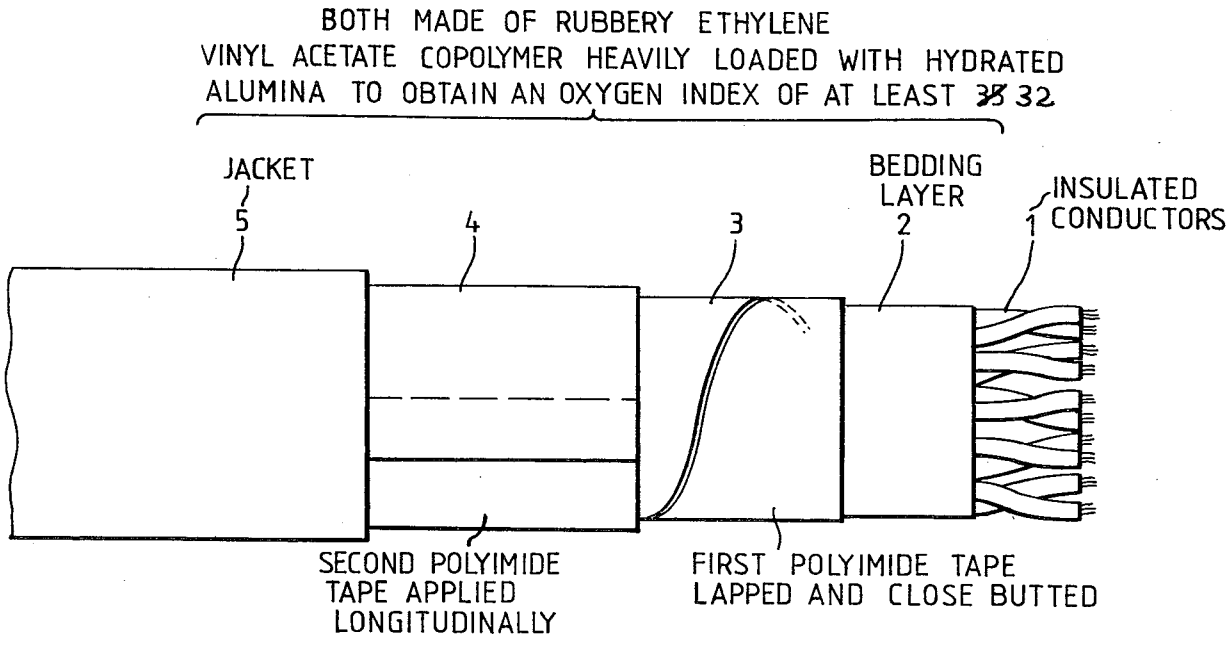
FIG. 1 is a cut-away diagram of one cable construction in accordance with the invention.

The cable of FIG. 1 is a railroad signalling cable with a core 1 made up of any required number of pairs of insulated conductors, a bedding layer 2, a first aromatic polyimide tape 3 applied helically with its edges closely abutted, a second aromatic polyimide tape 4 applied longitudinally with its edges overlapped; anda jacket 5. Further details are given in the Examples below.

Figure 2:
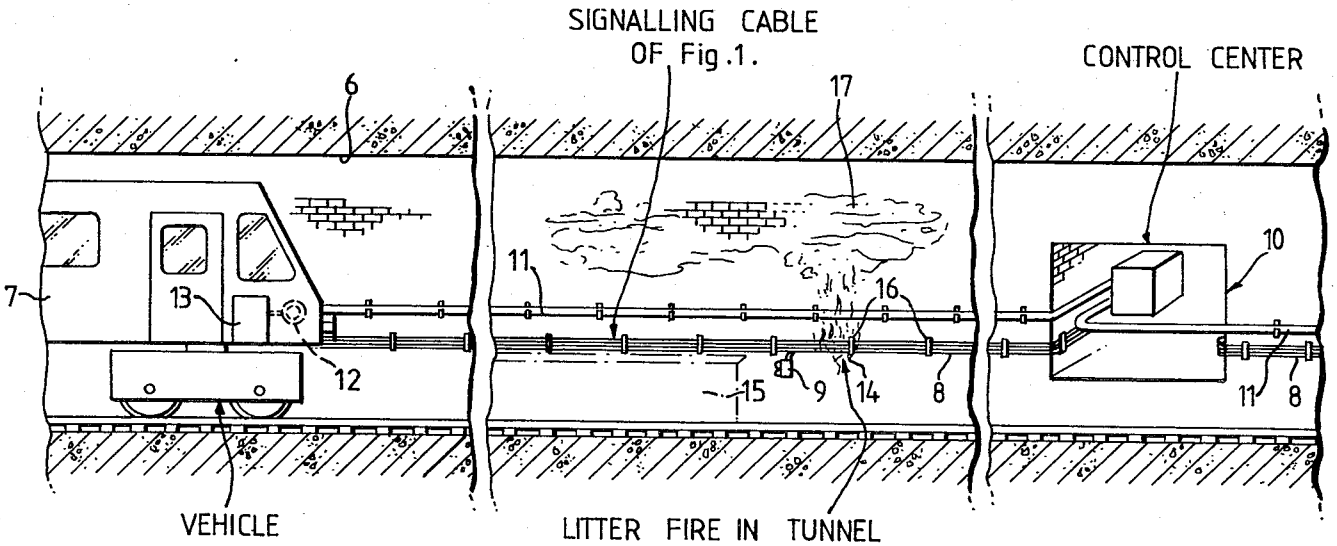
FIG. 2 is a diagram of a mass-transit system that can use the cable of FIG. 1.

The mass-transit system of FIG. 2 comprises a tunnel 6 through which a train 7 or other vehicle runs. The cable of FIG. 1, reference 8, is used to connect signalling equipment 9 to a control center 10. Other cables 11, such as a radiating cable for providing communication between the control center and the vehicle using an antenna coil 12 and transceiver 13 may be present; these are preferably also cables within the scope of this application (though for the radiating cable, the invention of Arthur J. Willis U.S. application Ser. No. 92,641 filed Nov. 8, 1979, can alternatively be used).

The figure illustrates a hazard situation in which a quantity of paper litter 14 has been blown from an underground station platform 15 of the transportation system by the air currents generated by a preceding train, has caught in one of the supports 16 for the cables 8 and has been ignited by the fanning effect of air currents on a smouldering cigarette end carried with it. The resulting small, cool fire presents no primary hazard to the vehicle, but if conventional cables are used there is a risk that the mass-transmit system will be brought to a standstill through failure of signalling and other communications and/or traction current supply due to damage to the cables 8, 11, etc., and that passengers trapped in a stationary vehicle may be exposed to an unpleasant and possibly dangerous level of smoke 17; the smoke would also hamper remedial action by mass-transit personnel. By using the cables of our invention, smoke hazard is reduced to a very low level and in some cases the cable may continue to function until this kind of fire has burned itself out, allowing repair work to be deferred until the mass-transit system is closed down for the right.

EXAMPLES

A first preferred cable jacketing and bedding compound (compound A) comprises 30% of a 60% ethylene-40% vinyl acetate copolymer (Levapren 400), 62.2% hydrated alumina, 1.89% stearic acid, a curing system comprising 4.44% of a proprietary peroxide masterbatch known as Trigonox X29/40 MB and including minor amounts of a polymer and a filler and 1.0% of an accelerator known as Drimix, which is understood to be triallyl cyanurate, and 0.47% of an antioxidant known as Vulkanox DDA. A second preferred cable jacketing and bedding compound (compound B) comprises 24% of the same 60% ethylene-40% vinyl acetate copolymer, 73% hyrated alumina, 2.5% stearic acid and 0.5% of the same antioxidant. In both cases the hydrated alumina has a mean particle size of 1 micrometer and the following distribution:

below 2 micrometers, 100%
below 1 micrometer, 85%
below ½ micrometer, 28%

Properties of this preferred bedding compound are as follows:

(1) halogen-free (2) oxygen index (ASTM D-2863) about 40 for compound A, 57 for compound B (3) tensile strength about 5 $MN/m^2$ for compound A and 3.0 $MN/m^2$ for compound B (4) elongation to break about 350% for compound A, 800% for compound B (5) permittivity 5.5 for compound A, 5.9 for compound B (6) power factor 2.0% for compound A, 2.8% for compound B (7) volume resistivity $3.2\times10^{11}$ ohm m for compound A, $7.6\times10^{10}$ ohm m for compound B.

Similar compounds made with a similar hydrated alumina with a mean particle size of 6 micrometers proved very difficult to process and gave completely unsatisfactory physical properties, and attempts to make similar compounds with a similar hydrated alumina of mean particle size 0.5 micrometer were abandoned because they were almost impossible to process on the type of compounding apparatus customarily used in the cable industry.

The properties of Compound A were compared with compounds having 1.5 and 3 parts of vinyl trimethoxy silane added, with the following results:

| Silane addition (parts by weight) | Tensile Strength $MN/m^2$ | Elongation at break (%) (100 mm sample) |
|---|---|---|
| nil | 5.0 | 330 |
| 1.5 | 5.2 | 90 |
| 3.0 | 7.2 | 80 |

Thus very small amounts of silane were shown to have an unacceptable effect on elongation (notwithstanding a small improvement in tensile strength).

The preferred jacketing and bedding compounds were used to make cables as follows:

1. Tinned copper strands each made up of seven 0.30 mm diameter wires are insulated with 0.8 mm radial thickness of a conventional insulating compound and cured, this compound (hereinafter called compound EPR 1) comprising:

| | |
|---|---|
| Ethylene/propylene/diene monomer rubber (EPDM) | 30–35% |
| China clay | 50% |
| Paraffinic plasticisers | 10–15% |
| Curing agents and antioxidants | 5% |
| (all percentages are by weight of the compound) | |

Pairs of these insulated conductors are twisted together with a right-hand lay of about 40 mm, and seven such twisted pairs laid up together with a left-hand lay of about 100 mm. An extruded bedding layer with a nominal radial thickness of 1 mm encloses the laid up cores; this bedding layer is of the compound A. Over this bedding is applied a copper tape electrical screen made of two tapes each (nominally) 18 mm wide and 0.08 mm thick, breaking joint with the edges of each tape nominally abutted. A second bedding layer 1.5 mm thick and made of compound A is extruded over the screen.

A heat barrier is next formed by lapping on a "Kapton H" (trademark) polyimide tape 0.08 mm thick and nominally 30 mm wide applied with its edges nominally abutting, and longitudinally applying a further similar tape 55 mm wide longitudinally (about 15% overlap).

An outer sheath of compound A with a radial thickness of 1.0 mm completes the cable, which has a nominal overall diameter of 17.3 mm.

This cable has after curing adequate mechanical properties, excellent low-smoke properties and good fire survival characteristics.

2–3. These are the same as Example 1 except that the Kapton tapes are respectively 0.05 mm and 0.03 mm thick. These cables have only marginally less good smoke and fire-survival characteristics compared with Example 1. 4. The cores of this cable are shielded concentric paris, with a tinned copper inner conductor 1.53 mm in diameter, inner dielectric of cured compound EPR 1 with a radial thickness of 1 mm, outer conductors made of thirty-five 0.3 mm diameter tinned copper wires lapped on with a lay of around 38 mm, outer dielectric also of cured compound EPR 1 and also 1 mm thick, and a braided screen made up of tinned copper wires each 0.15 mm in diameter, applied 16 spindles 4 ends with a lay of 11 mm, two-over-two-under.

Seven such cores are laid-up with one axial core and the remaining six surrounding it and having a right-hand lay of about 230 mm. A bedding of compound A is extruded over the laid-up cores and has a radial thickness of 2.5 mm. Two layers of the same polyimide tapes as in Example 1 (38 mm and 80 mm wide respectively) are applied in the same manner on the bedding, and an outer sheath of compound A, with a radial thickness of 2 mm, completes a cable with an overall diameter of around 30 mm. Relevant properties after curing are similar to Example 1.

5–7. These are substantially identical with Examples 1–3 respectively except that the stranded conductors are replaced by solid tinned-copper wires of 0.85 mm diameter and the radial thickness of the insulation is 0.6 mm.

8–9. These are the same as Examples 1 and 4 respectively except that compound B is used instead of compound A, and is uncured.

10. The conductors, insulation, stranding, bedding and sheathing of this cable are as in Example 1. Two "Kapton H" (trademark) polyimide tapes, 0.08 mm thick and nominally 30 mm wide, are both helically lapped on to the bedding layer, breaking joint. The cable is markedly less good than the cable of Example 1 both as to smoke emission and as to resistance to bending.

What we claim as our invention is:

1. A transportation system comprising at least one tunnel through which vehicles pass in operation and having electric cables extending longitudinally through said tunnel, characterised by the fact that at least one of said electric cables comprises a core comprising at least one polymer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having
- an oxygen index of at least 32 and up to about 50;
- a tensile strength of at least 2.5 and up to 10 $MN/m^2$;
- an elongation at break which is at least 200 and up to 500%;
- a permittivity of about 5.5–6.0;
- a power factor of about 2–4%;
- a volume resistivity in the region of $10^{11}$ ohm m;

and which, if burned, produces little visible smoke and no major amount of toxic or corrosive fumes and comprising by weight

- 20–35 parts of a rubbery ethylene-vinyl acetate copolymer comprising more than 28% and up to about 45% vinyl acetate;
- optionally up to 10 parts of another halogen-free polymer;
- 52–75 parts of an alumina trihydrate with at least half its weight in particles with a diameter in the range 0.5–3.0 micrometer;
- up to 3 parts of a lubricant selected from those fatty acids and salts thereof which are compatible with the composition; and
- at least one antioxidant and at least one curing agent in effective amounts not exceeding 4 parts in all; and said aromatic tape layer comprises at least two superposed tapes.

2. A transportation system comprising at least one tunnel through which vehicles pass in operation and having electric cables extending longitudinally through said tunnel, characterised by the fact that at least one of said electric cables comprises a core comprising at least one polymer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having
- an oxygen index of at least 32 and up to about 50;
- a tensile strength of at least 2.5 and up to 10 $MN/m^2$;
- an elongation at break which is at least 200 and up to 500%;
- a permittivity of about 5.5–6.0;
- a power factor of about 2–4%;
- a volume resistivity in the region of $10^{11}$ ohm m;

and which, if burned, produces little visible smoke and no major amount of toxic or corrosive fumes and comprising by weight

- 20–35 parts of a rubbery ethylene-vinyl acetate copolymer comprising more than 28% and up to about 45% vinyl acetate;
- optionally up to 10 parts of another halogen-free polymer;
- 52–75 parts of an alumina trihydrate with at least half its weight in particles with a diameter in the range 0.5–3.0 micrometer;
- up to 3 parts of a lubricant selected from those fatty acids and salts thereof which are compatible with the composition; and
- at least one antioxidant and at least one curing agent in effective amounts not exceeding 4 parts in all; and said aromatic tape layer comprises an inner tape helically applied to the bedding layer and an outer tape longitudinally applied to the inner tape.

3. A transportation system comprising at least one tunnel through which vehicles pass in operation and having electric cables extending longitudinally through said tunnel, characterised by the fact that at least one of said electric cables comprises a core comprising at least one polymer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having
- an oxygen index of at least 32 and up to about 50;
- a tensile strength of at least 2.5 and up to 10 $MN/m^2$;
- an elongation at break which is at least 200 and up to 1000%;
- a permittivity of about 5.5–6.0;
- a power factor of about 2–4%;
- a volume resistivity in the region of $10^{11}$ ohm m;

and which, if burned, produces little visible smoke and no major amount of toxic or corrosive fumes and comprising by weight 20–35 parts of a rubbery ethylene-vinyl acetate copolymer comprising more than 28% and up to about 45% vinyl acetate;

optionally up to 10 parts of another halogen-free polymer;

52–75 parts of an alumina trihydrate with at least half its weight in particles with a diameter in the range 0.5–3.0 micrometer;

up to 3 parts of a lubricant selected from those fatty acids and salts thereof which are compatible with the composition; and at least one antioxidant in an effective amount not exceeding 4 parts in all; and said aromatic tape layer comprises at least two superposed tapes.

4. A transportation system comprising at least one tunnel through which vehicles pass in operation and having electric cables extending longitudinally through said tunnel, characterised by the fact that at least one of said electric cables comprises a core comprising at least one polymer-insulated conductor, a bedding layer surrounding said core, an aromatic polyimide tape layer applied closely around said bedding layer, and a jacket applied closely around said tape layer, wherein (a) both said bedding layer and said jacket are made of a halogen-free, silane-free composition having an oxygen index of at least 32 and up to about 50;

a tensile strength of at least 2.5 and up to 10 $MN/m^2$;

an elongation at break which is at least 200 and up to 1000%;

a permittivity of about 5.5–6.0;

a power factor of about 2–4%;

a volume resistivity in the region of $10^{11}$ ohm m;

and which, if burned, produces little visible smoke and no major amount of toxic or corrosive fumes and comprising by weight 20–35 parts of a rubbery ethylene-vinyl acetate copolymer comprising more than 28% and up to about 45% vinyl acetate;

optionally up to 10 parts of another halogen-free polymer;

52–75 parts of an alumina trihydrate with at least half its weight in particles with a diameter in the range 0.5–3.0 micrometer;

up to 3 parts of a lubricant selected from those fatty acids and salts thereof which are compatible with the composition; and at least one antioxidant in an effective amount not exceeding 4 parts in all; and said aromatic tape layer comprises an inner tape helically applied to the bedding layer and an outer tape longitudinally applied to the inner tape.

* * * * *